US006298812B1

(12) United States Patent
Izuo et al.

(10) Patent No.: US 6,298,812 B1
(45) Date of Patent: Oct. 9, 2001

(54) VALVE DRIVING APPARATUS PROVIDED IN AN INTERNAL COMBUSTION ENGINE

(75) Inventors: Takashi Izuo; Tatsuo Iida; Masahiko Asano; Hiroyuki Hattori, all of Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/419,642

(22) Filed: Oct. 18, 1999

(30) Foreign Application Priority Data

Oct. 19, 1998 (JP) ..... 10-297323

(51) Int. Cl.[7] ..... F01L 9/04
(52) U.S. Cl. ..... 123/90.11; 123/90.65
(58) Field of Search ..... 123/90.11, 90.65, 123/90.66, 90.67

(56) References Cited

U.S. PATENT DOCUMENTS

| | | | | |
|---|---|---|---|---|
| 5,611,303 | * | 3/1997 | Izuo | 123/90.11 |
| 5,636,601 | * | 6/1997 | Moriya et al. | 123/90.11 |
| 5,669,341 | * | 9/1997 | Ushirono et al. | 123/90.11 |
| 5,743,225 | * | 4/1998 | Sakurai | 123/90.65 |
| 6,089,196 | * | 7/2000 | Izuo et al. | 123/90.11 |

FOREIGN PATENT DOCUMENTS

| | | |
|---|---|---|
| 0 967 368 | 12/1999 | (EP) . |
| 9-256825 | 9/1997 | (JP) . |
| WO 95/30104 | 11/1995 | (WO) . |

* cited by examiner

*Primary Examiner*—Weilun Lo
(74) *Attorney, Agent, or Firm*—Finnegan, Henderson, Farabow, Garrett & Dunner, L.L.P.

(57) ABSTRACT

A valve driving apparatus for driving an intake and an exhaust valve uses electromagnetic force and is provided in an internal combustion engine. Each intake and exhaust valve is movable between an open position and a closed position. The valve driving apparatus includes an intake armature coupled with the intake valve, an exhaust armature coupled with the exhaust valve, an intake valve opening spring for generating a force exerted on the intake valve in the direction of the open position of the intake valve, an intake valve closing spring for generating a force exerted on the intake valve in the direction of the closed position of the intake valve, an exhaust valve opening spring for generating a force exerted on the exhaust valve in the direction of the open position of the exhaust valve, and an exhaust valve closing spring for generating a force exerted on the exhaust valve in the direction of the closed position of the exhaust valve. A spring constant of the exhaust valve opening spring is greater than a spring constant of the intake valve opening spring. When the spring constant of the exhaust valve opening spring is high, an amplitude damping value of the exhaust valve is small. Since an amplitude damping value of the exhaust valve is smaller, an exciting electric current necessary for supplying to an exhaust lower coil can be restrained lower. Therefore, an electric power consumed by the valve driving apparatus can be saved.

14 Claims, 5 Drawing Sheets

VALVE DRIVING APPARATUS PROVIDED IN AN INTERNAL COMBUSTION ENGINE

FIELD OF THE INVENTION

The present invention relates to a valve driving apparatus provided in an internal combustion engine. Especially, the valve driving apparatus drives an intake valve or exhaust valve to be movable between an open position and a closed position, by using electromagnetic force and a spring force in cooperation.

BACKGROUND OF THE INVENTION

A valve driving apparatus which drives an intake valve and an exhaust valve by using electromagnetic force in an internal combustion engine is already known, as disclosed in Japanese Laid-Open Patent Application No. 9-256825. This type of the valve driving apparatus includes a valve which functions as an intake valve or an exhaust valve, an armature coupled with the intake valve or an exhaust valve, two valve springs which generate force exerted on the intake valve or the exhaust valve, and two electromagnets (an upper electromagnet and a lower electromagnet) disposed in the moving direction of the armature.

In the aforementioned valve driving apparatus, the intake valve or the exhaust valve moves toward the upper electromagnet by the electromagnetic force applied to the armature when an exciting electric current is supplied to the upper electromagnet, because the valve is coupled with the armature. Thereafter, the valve moves toward the lower electromagnet by the force exerted by the valve spring because the electromagnetic force disappears when the exciting current to the upper electromagnet stops. When the exciting current is supplied to the lower electromagnet at the point when the valve reaches near the lower electromagnet, the valve furthermore moves toward the lower electromagnet by the electromagnetic force exerted to the armature. According to the above-mentioned valve driving apparatus, the valve can be driven to open or close, by supplying the exciting current alternately to two of the electromagnets in the appropriate timing.

In order to enhance a volume efficiency of intake air to a combustion chamber of an internal combustion engine, the opening port from an intake port to the combustion chamber may have a large diameter. If the opening port has a large diameter, however, the diameter of the intake valve becomes larger. It results in that the mass of the intake valve is greater. In this case, a moving speed of the intake valve becomes lower. Consequently, the reciprocating interval from a full open position to a full closed position of the intake valve becomes longer. On the other hand, concerning a moving speed of the valve, the greater a spring constant of the valve spring which exerts a force to the valve is, the faster the valve moves. This means that it is better for the spring constant of the intake valve spring to be greater, in order to shorten the reciprocating interval if the diameter of the intake valve is large.

When the spring constant of the intake valve spring becomes higher in the internal combustion engine, however, the exerted spring force on the intake valve becomes greater. It is necessary to increase the electromagnetic force for compensating the excessive spring force, so that the intake valve is held at the full open position or full closed position against the large exerted spring force. Consequently, if the spring constant of the intake valve spring is high, the exciting current necessary for holding the intake valve at the full open position or the full closed position is higher, and it results in the increase of consumed electric power of the intake valve. Therefore, it has an advantage that the spring constant of the intake spring exerting on the intake valve is lower, in order to restrain the consumed electric power for driving the intake valve.

As mentioned above, it is necessary that the spring constant of the intake spring exerted on the intake valve is appropriately determined by taking into consideration reducing the reciprocating interval of the intake valve and reducing the consumed power energy necessary for holding the intake valve at the full open or full closed position.

In the process of opening the intake valve (called intake stroke), the combustion chamber is maintained at the low pressure. In this condition, the intake valve can be opened by a low electromagnetic force, because the pressure which exerts a force toward the intake valve in the closing direction is low.

On the other hand, in the process of opening the exhaust valve (called exhaust stroke), the combustion chamber is at the high pressure, because high pressure combustion gas remains in the combustion chamber after the exhaust stroke. In this case, an amplitude damping value of the exhaust valve becomes higher in the process of the exhaust valve in the opening direction. Greater electromagnetic force is necessary for opening the exhaust valve in the condition where the amplitude damping value of the exhaust valve is higher. Accordingly, it is necessary that a higher exciting electric current is supplied to the lower electromagnet in this case than in the case of opening the intake valve. Then, the consumed electric power for the exhaust valve increases.

The higher the spring constant of the spring exerting the force on the intake or exhaust valve, the lower the above-mentioned amplitude damping value is. If the amplitude damping value is low, it is not necessary to generate a large electromagnetic force in order to move the exhaust valve in the opening direction. Consequently, it is better to adopt the higher spring constant of the spring exerting the force on the exhaust valve, in order to restrain the consumed electric power lower to move the exhaust valve in the opening direction.

In the conventional valve driving apparatus, however, the spring constants of the intake and exhaust springs are set to be equal. Therefore, when the spring constant of the intake spring is designed to gain the optimum characteristics, the consumed electric power in the process of opening the exhaust valve increases because the amplitude damping value is high in the opening process of the exhaust valve. Furthermore, when the spring constant of the exhaust spring is designed to be higher in order to restrain the consumed electric power of the exhaust valve lower, the consumed electric power for holding the intake valve at the full open or full closed position becomes higher, according to the conventional valve driving apparatus.

SUMMARY OF THE INVENTION

It is thus one object of the present invention to solve the aforementioned problem. Another object of the invention is to provide a valve driving apparatus for an internal combustion engine which reduces consumed electric power necessary for driving an exhaust valve while maintaining high response of the intake valve and saving the consumed electric power for the intake valve.

According to one aspect of the invention, a valve driving apparatus in an internal combustion engine drives an intake valve and an exhaust valve, using electromagnetic force. The intake and exhaust valves are respectively movable between an open position and a closed position. The valve driving apparatus includes an intake and an exhaust armatures respectively coupled with the intake and exhaust valves, and an intake valve spring and an exhaust spring respectively for generating force exerted on the intake and exhaust valves. In this structure of the valve driving apparatus, a spring constant of the exhaust valve spring is greater than a spring constant of the intake valve spring.

Because the spring constant of the exhaust valve spring is high, an amplitude damping value of the exhaust valve is low. When the amplitude damping value of the exhaust valve is low, an electromagnetic force necessary for exerting the exhaust valve becomes small. Consequently, an exciting electric current supplied to an electromagnetic coil for driving the exhaust valve can be restrained low, during driving the exhaust valve between the full open and full closed position. Therefore, the consumed electric power necessary for driving the exhaust valve can be reduced.

Furthermore, if the spring constant of the exhaust valve spring is high, the moving speed of the exhaust valve becomes high. When the speed of the exhaust valve is high, the exhaust valve moves in shorter time from the full closed position to the full open position. In this case, the exhaust process after the combustion is executed quickly, because an active angle of the internal combustion engine becomes high. If the exhaust process is executed more quickly, a higher torque can be generated, even though the engine revolves at high revolutions. Therefore, the output torque of the engine can be improved in high revolutions range.

BRIEF DESCRIPTION OF THE DRAWINGS

The above and other objects, features, advantages, and technical and industrial significance of this invention will be better understood by reading the following detailed description of a presently preferred embodiment of the invention, when considered in connection with the accompanying drawing, in which.

DETAILED DESCRIPTION OF PREFERRED EMBODIMENTS

Figure 1:
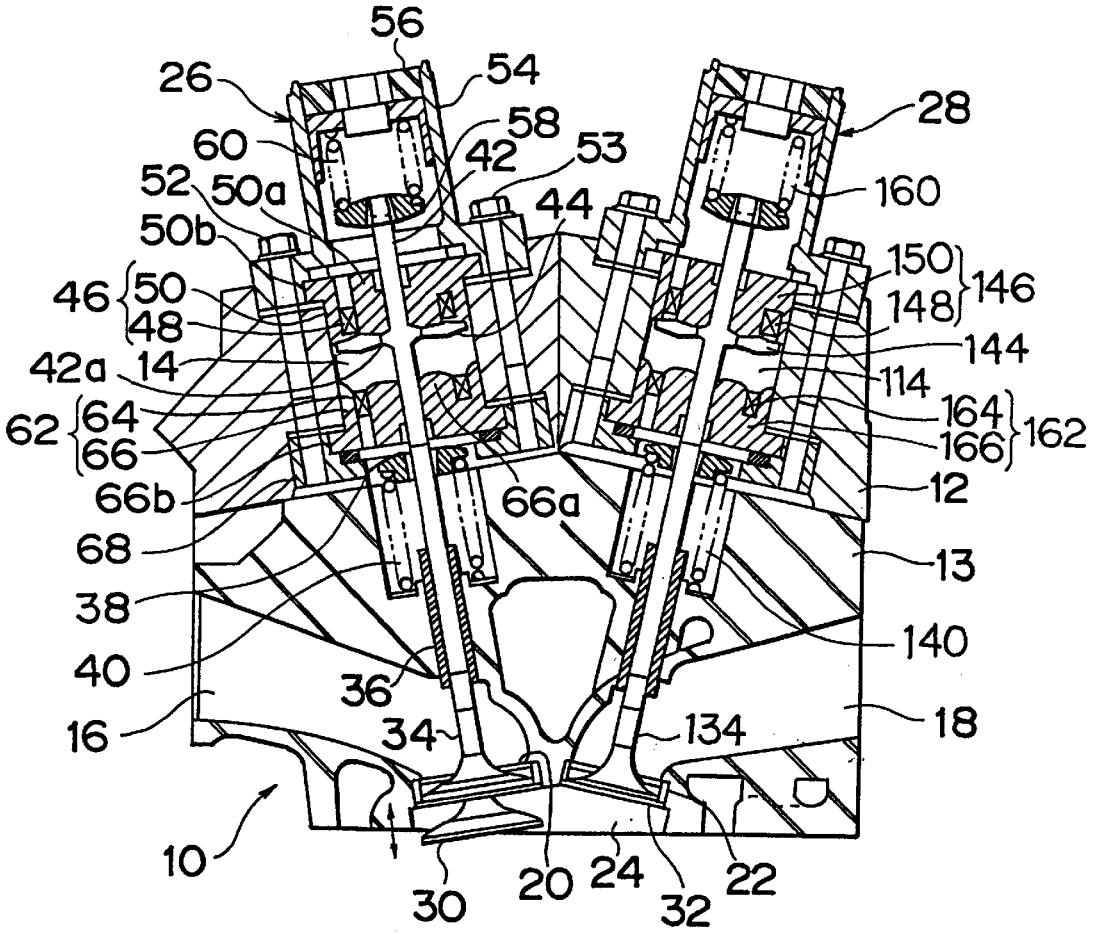
FIG. 1 is a part of a longitudinal cross-sectional view of an internal combustion engine with a valve driving apparatus according to one embodiment of the present invention.

In the following description and the accompanying drawings, the present invention will be described in more detail in terms of specific embodiments. FIG. 1 shows a longitudinal cross-sectional view of a main part of an internal combustion engine 10 for explaining one embodiment of the present invention. While the engine of this embodiment is a multi-cylinder internal combustion engine, a part corresponding to only one cylinder is illustrated in FIG. 1.

The engine 10 includes an upper head 12 and a lower head 13. A couple of through-holes 14, 114 are shaped in the upper head 12. An intake port 16 and an exhaust port 18 are shaped in the lower head 13. An intake valve seat 20 is shaped at the opening edge of the intake port 16 toward a combustion chamber 24. In the same way, an exhaust valve seat 22 is shaped at the opening edge of the exhaust port 18 from the combustion chamber 24. The opening edge area of the intake port 16 toward the combustion chamber 24 is larger than the opening edge area of the exhaust port 18 from the combustion chamber 24.

An intake valve driving apparatus 26 and an exhaust valve driving apparatus 28 are respectively provided partially inside the intake through-hole 14 and the exhaust through-hole 114 in the upper head 12. An intake valve 30 is coupled with the intake valve driving apparatus 26, and the intake valve driving apparatus 26 drives the intake valve 30. In the same manner, an exhaust valve 32 is coupled with the exhaust valve driving apparatus 28, and the exhaust valve driving apparatus 28 drives the exhaust valve 32. The intake port 16 connects to the combustion chamber 24 when the intake valve 30 is apart from the intake valve seat 20, and the intake port 16 is cut from the combustion chamber 24 when the intake valve 30 touches and is seated on the intake valve seat 20. In the same way, the exhaust port 18 connects to the combustion chamber 24 when the exhaust valve 32 is apart from the exhaust valve seat 22, and the exhaust port 18 is cut from the combustion chamber 24 when the exhaust valve 32 touches and is seated on the exhaust valve seat 22.

Next, the structure of the intake valve driving apparatus 26 is depicted. The intake valve driving apparatus 26 includes an intake valve stem 34 which is coupled with the intake valve 30. An intake valve guide 36, which supports the intake valve stem 34 sliding up-and-down in the axial direction, is fixed inside the lower head 13. An intake lower retainer 38 connects to the upper part of the intake valve stem 34. An intake valve closing spring 40 is under the intake lower retainer 38. The intake valve closing spring 40 exerts a force upwards on the intake lower retainer 38 in FIG. 1, and this indicates that the intake valve closing spring 40 exerts a force to the closing direction on the intake valve 30.

The upper end of the intake valve stem 34 is coupled with an intake armature shaft 42. The intake armature shaft 42 is shaped like a rod and made of non-magnetic materials. In the center part of the intake armature shaft 42 in the up-and-down direction, an intake armature holder 42*a* intrudes outward in the radial direction. An intake armature 44 is circumferentially coupled with the intake armature holder 42*a*. The intake armature 44 is ring-shaped and made of soft magnetic materials.

Upwards from the intake armature 44, an intake upper electromagnet 46 is provided. The intake upper electromagnet 46 includes an intake upper coil 48 and an intake upper core 50. The intake upper core 50 is cylindrical-shaped and made of electromagnetic materials. The intake armature shaft 42 is supported to be able to slide in the center of the intake upper core 50. The intake upper core 50 includes an intake upper main core 50*a* which fits to the intake through-hole 14, and an intake upper flange 50*b* having a diameter larger than the diameter of the intake upper main core 50*a*.

An intake upper cap 54 is fixed to the upper head 12 by bolts 52, 53. The intake upper cap 54 is cylindrical-shaped and surrounds the intake upper flange 5*b* of the intake upper core 50. An intake adjust bolt 56 is fixed to an upper part of the intake upper cap 54 by a screw. An intake upper retainer 58 is connected to the upper part of the intake armature shaft 42. An intake valve opening spring 60 is provided between the intake adjust bolt 56 and the intake upper retainer 58. The intake valve opening spring 60 exerts a force downwards on the intake upper retainer 58 and the intake armature shaft 42 in FIG. 1, and this indicates that the intake valve opening spring 60 exerts a force to the opening direction on the intake valve 30.

An intake lower electromagnet 62 is below the intake armature 44. The intake lower electromagnet 62 includes an intake lower coil 64 and an intake lower core 66. The intake lower core 66 is cylindrical and made of electromagnetic materials. The intake lower core 66 supports the intake armature shaft 42 to enable it to slide up-and-down in the center of the intake lower core 66. An intake lower main core 66*a*, which fits to the intake through-hole 14 in the upper head 12, and an intake lower flange 66*b*, having a diameter larger than the diameter of the intake lower main core 66*a*, are shaped in the intake lower core 66. In the lower part of the upper head 12, an intake lower cap 68 is fixed to the upper head 12 by bolts 52, 53. The intake lower cap 68 is cylindrical and surrounds the intake lower flange 66*b* of the intake lower core 66.

In the intake valve driving apparatus 26, the bolts 52, 53 are adjusted, so that the distance between the intake upper core 50 and the intake lower core 66 is a predetermined value. The intake adjust bolt 56 is adjusted so that the neutral position of the intake armature 44 is at the middle between the intake upper core 50 and the intake lower core 66.

Concerning the exhaust valve driving apparatus 28, an exhaust valve opening spring 160 and an exhaust valve closing spring 140 are provided on behalf of the intake opening spring 60 and the intake valve closing spring 40 in the intake valve driving apparatus 26. Hereinafter, the number affixed to each corresponding part is added by 100 to the number affixed to in the above-mentioned intake valve driving apparatus 26, and "exhaust" is added at the head of each name of the part instead of "intake". A spring constant of the exhaust valve opening spring 160 is greater than a spring constant of the intake valve opening spring 60. In this embodiment, a spring constant of the exhaust valve opening spring 160 is equal to or substantially equal to a spring constant of the exhaust valve closing spring 140, and a spring constant of the intake valve opening spring 60 is equal to or substantially equal to a spring constant of the intake valve closing spring 40.

As mentioned above, the opening edge of the intake port 16 to the combustion chamber 24 has the greater diameter than the diameter of the opening edge of the exhaust port 18 from the combustion chamber 24. Consequently, the diameter of the exhaust valve 32 is smaller than the diameter of the intake valve 30.

In this embodiment, the exhaust valve driving apparatus 28 acts in the same manner as the intake valve driving apparatus 26. Hereinafter, the action of the intake valve driving apparatus 26 is explained on behalf of both driving apparatuses 26 and 28.

When an exciting electric current is not supplied to the intake upper coil 48 and the intake lower coil 64 in the intake valve driving apparatus 26, the intake armature 44 is maintained at the neutral position between the intake upper core 50 and the intake lower core 66. In this condition the intake valve 30 is positioned at the middle between the full open and the full closed positions.

In such a condition as mentioned above, when the exciting current begins to be supplied to the intake upper coil 48, the intake upper electromagnet 46 generates an electromagnetic force attracting the intake armature 44 toward the intake upper electromagnet 46. Accordingly, the intake valve 30 with the intake armature 44 moves upwards in FIG. 1, and continues to move until the intake armature 44 touches the intake upper core 50. When the intake armature 44 touches the intake upper core 50, the intake valve 30 seats on the intake valve seat 20. This condition indicates the full closed position of the intake valve 30.

When the exciting current to the intake upper coil 48 is suspended in the condition of the full closed position of the intake valve 30, the electromagnetic force applied to the intake armature 44 disappears. When the electromagnetic force stops, the intake armature 44 and the intake valve 30 begins to move downwards in FIG. 1, by the exerted force of the intake valve opening spring 60.

When the intake armature 44 and the intake valve 30 moves downwards by a predetermined distance in FIG. 1, the exciting current to the intake lower coil 64 is supplied. Then, the intake lower electromagnet 62 generates an electromagnetic force attracting the intake armature 44 toward the intake lower electromagnet 62, and the intake armature 44 continues to move until it touches the intake lower core 66. When the intake armature 44 touches the intake lower core 66, the intake valve 30 is at the full open position.

As mentioned above, the intake valve 30 can be driven toward the full closed position by supplying the exciting current to the intake upper coil 48. In the same way, the intake valve 30 can be driven toward the full open position by supplying the exciting current to the intake lower coil 64. Consequently, according to this embodiment of the intake valve driving apparatus, the intake valve 30 can be appropriately opened and closed by supplying the exciting current alternately to the intake lower coil 64 and the intake upper coil 48.

As mentioned above, the opening edge area of the intake port 16 toward the combustion chamber 24 is larger than the opening edge area of the exhaust port 18 from the combustion chamber 24. Therefore, a volume efficiency of intake air from the intake port 16 to the combustion chamber 24 is higher. This indicates that higher efficient combustion can be realized by drawing a larger volume of air into the combustion chamber 24 in a shorter time.

When the opening edge area of the intake port 16 toward the combustion chamber 24 is large, the diameter of the intake valve 30 is large and the mass of the intake valve 30 also becomes high. If the mass of the intake valve 30 is high, the moving speed of the intake valve 30 becomes low. Therefore, an interval necessary for the intake valve 30 to move from the full open position to the full closed position (hereinafter called transition time) becomes longer. Incidentally, the greater the spring constant of the intake valve opening and closing springs are, the higher the moving speed of the intake valve 30 is. Consequently, it is advantageous to set large spring constants of the intake valve opening and closing springs, in order to shorten the transition time while maintaining a large diameter intake valve 30.

When the spring constants of the intake valve opening and closing springs 60, 40 are large, exerted force on the intake valve 30 by the intake valve opening and closing springs 60, 40 becomes large. It is necessary to exert large electromagnetic force on the intake valve 30 in order to hold the intake valve 30 at the full open position or at the full closed position against the above-mentioned exerted force by the closing spring 40 or the opening spring 60. Accordingly, if the spring constants of the opening and closing springs 60, 40 are large, the exciting current necessary for holding the intake valve 30 at the full open or full closed position becomes high, and the consumed electric power increases. Therefore, it is advantageous to set the spring, constants of the intake valve opening spring 60 and the intake valve closing spring 40 small, in order to restrain the consumed electric power low in opening and closing the intake valve 30.

Considering the above-mentioned point, in this embodiment, the spring constants of the intake valve opening spring 60 and the intake valve closing spring 40 are appropriately determined with the consideration of the transition time of the intake valve 30 and the electromagnetic force for holding the intake valve 30 at the full open or full closed position. This indicates that the consumed electric power of the intake valve driving apparatus 26 can be reduced with reducing the transition time of the intake valve 30.

Figure 2:
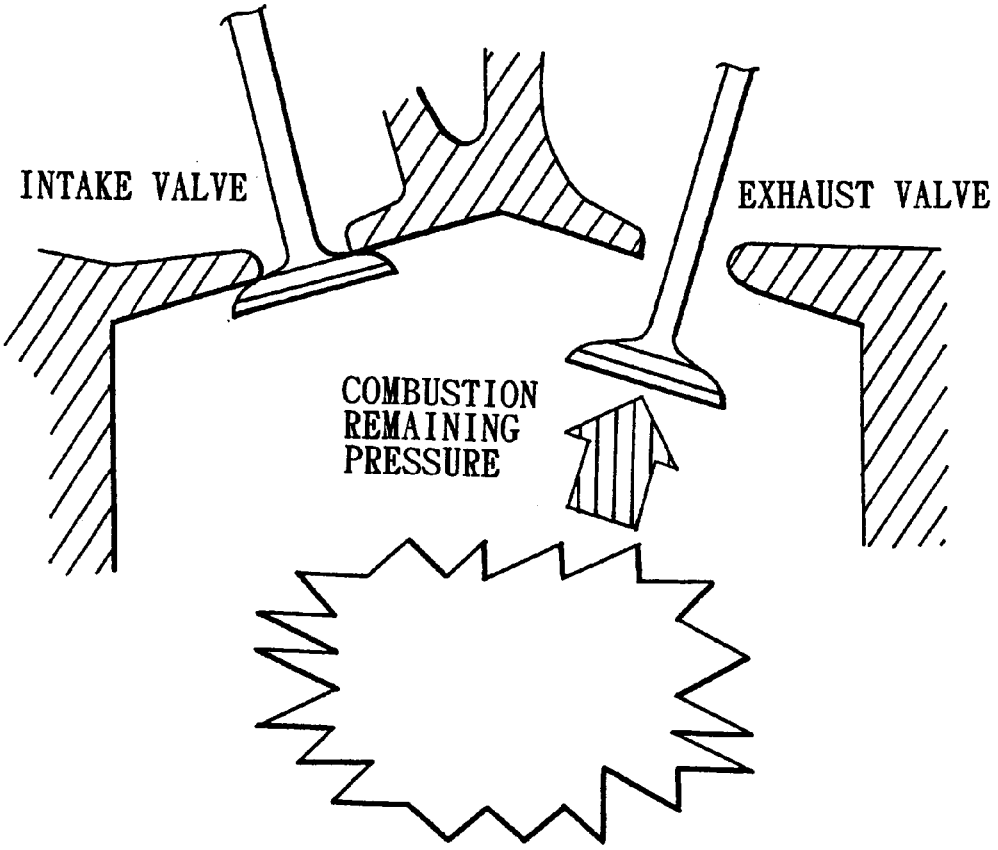
FIG. 2 explains a condition of an intake valve and an exhaust valve in an exhaust process after combustion in a combustion chamber.

FIG. 2 illustrates a condition schematically where the internal combustion engine 10 is in the exhaust stroke after the combustion and expansion stroke. In the intake stroke in which the intake valve 30 is opening, the combustion chamber 24 is maintained at low pressure. Since the pressure in the closing direction exerted on the intake valve 30 is low in this condition, the intake valve 30 can be opened by the small electromagnetic force.

On the other hand, as shown in FIG. 2, in the exhaust stroke in which the exhaust valve 32 is opening, the combustion chamber 24 is maintained at high pressure because gas after the combustion remains at high pressure in the combustion chamber 24. Since the high pressure in the closing direction exerts on the exhaust valve 32, the amplitude damping value of the exhaust valve 32 becomes high in the process of the exhaust valve 32 moving in the opening direction.

In order to open the exhaust valve 32 which has a high amplitude damping value, it is necessary to supply a higher exciting current to the exhaust lower coil 64 than in the case of opening the intake valve 30. Therefore, the consumed electric power increases. Consequently, it is desirable that the amplitude damping value of the exhaust valve 32 is as small as possible to open the exhaust valve 32 with less electric power.

Figure 3:
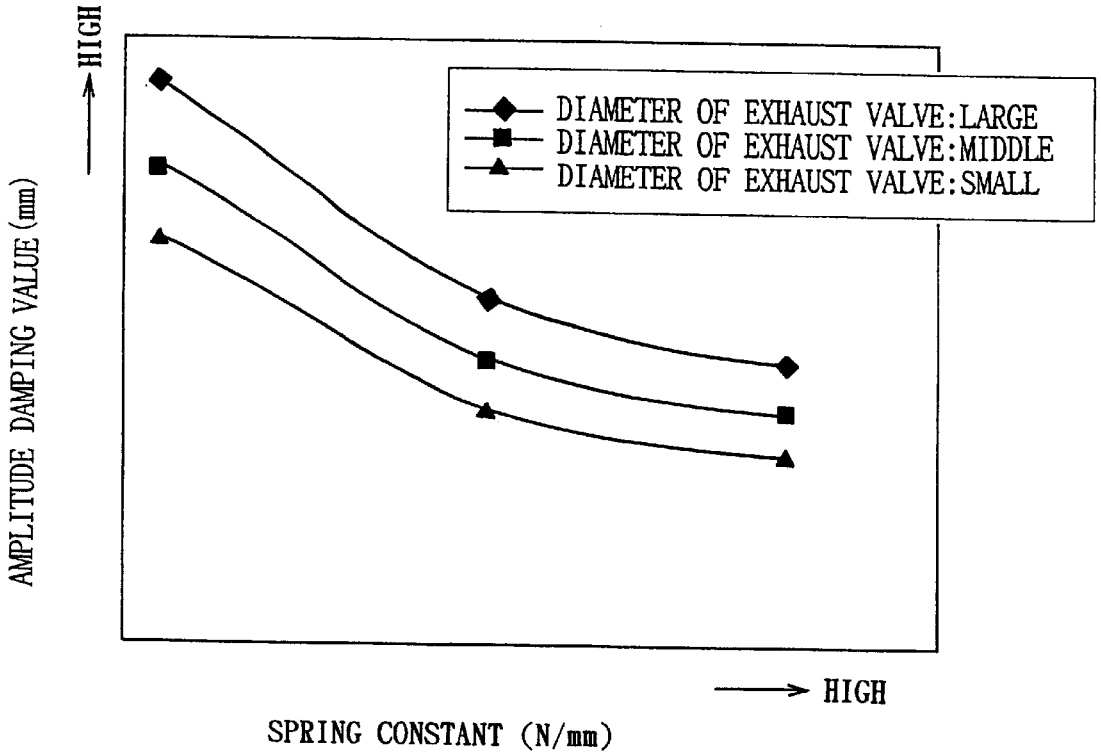
FIG. 3 is a graph showing the relation of a spring constant of an exhaust valve spring versus an amplitude damping value, with a diameter of the exhaust valve as a parameter.

FIG. 3 shows the relation of an amplitude damping value of the exhaust valve 32 versus the spring constant of the exhaust valve opening spring 160 or the exhaust valve closing spring 140. Furthermore, in FIG. 3 cases where the diameter of the exhaust valve 32 is varied at large, middle, or small, are shown. Referring to FIG. 3, the higher the spring constant of the opening spring 160 or the closing spring 140 is, the lower the amplitude damping value of the exhaust valve 32 is. Accordingly, it is desirable that the spring constants of the exhaust valve opening and closing springs 160, 140 are greater than the spring constants of the intake valve opening and closing springs 60, 40, in order to restrain the amplitude damping value of the exhaust valve 32 low.

As mentioned above, in this embodiment, the spring constants of the exhaust valve opening spring 160 and the closing spring 140 are greater than the spring constants of the intake valve opening spring 60 and the closing spring 40. Consequently, since the amplitude damping value of the exhaust valve 32 becomes low, the exciting current necessary for supplying the exhaust upper coil 148 or the exhaust lower coil 164 is restrained low in reciprocating the exhaust valve 32 between the full open and full closed positions.

According to the above-mentioned fact, it is possible to open the exhaust valve 32 by the consumed electric power with the same level as the electric power for opening the intake valve 30. Therefore, it can be achieved to reduce the consumed electric power of the exhaust valve driving apparatus 28, which drives the exhaust valve 32 according to this embodiment.

Moreover, as depicted in FIG. 3, the smaller the diameter of the exhaust valve 32 is, the lower the amplitude damping value of the exhaust valve 32 is. Accordingly, it is desirable to set the diameter of the exhaust valve 32 smaller to restrain the amplitude damping value of the exhaust valve 32 lower.

In this embodiment, as mentioned above, the diameter of the exhaust valve 32 is smaller than the diameter of the intake valve 30. Consequently, the exciting current necessary for supplying the exhaust upper coil 148 or the exhaust lower coil 164 can be restrained further lower, since the amplitude damping value of the exhaust valve 32 becomes smaller. As mentioned above, since the exhaust valve 32 is designed to have a small diameter in the internal combustion engine 10 of this embodiment, the consumed electric power of the exhaust valve driving apparatus 28 can be further reduced.

Furthermore, since the exciting current necessary for supplying the exhaust upper coil 148 or the exhaust lower coil 164 is restrained low when the exhaust valve 32 is driven between the full open and the full closed positions, the exhaust upper electromagnet 146 and lower electromagnet 162 can be designed to have a small size. Therefore, the exhaust valve driving apparatus 28 can be smaller in size.

Figure 4:
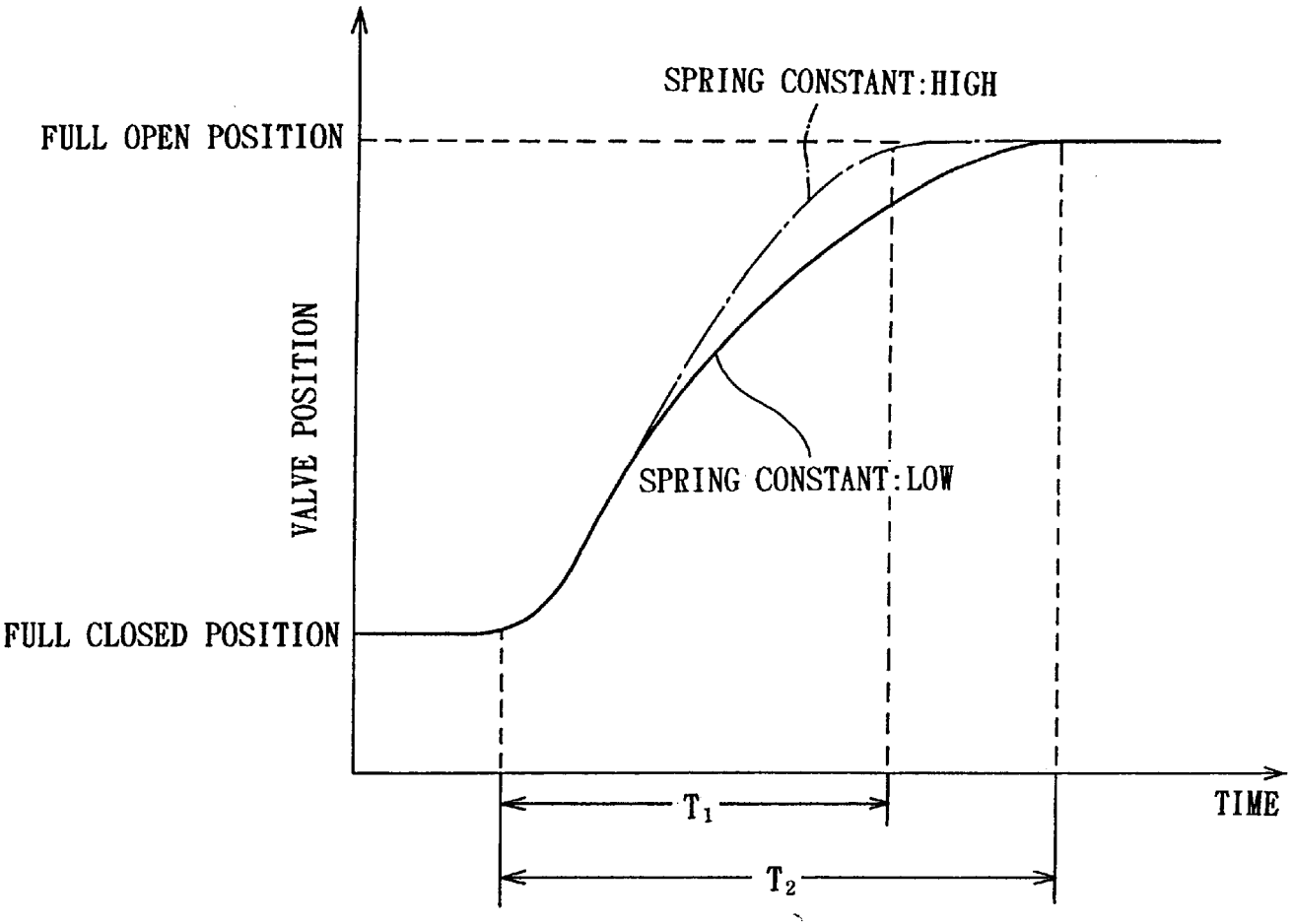
FIG. 4 is a graph showing a comparison of a valve moving time between a valve driving apparatus with a high spring constant and a valve driving apparatus with a low spring constant.

FIG. 4 shows the comparison of the transition time T of the exhaust valve 32 in the exhaust valve driving apparatus 28 between in the case where the spring constants of the exhaust valve opening and closing springs 160, 140 are high and in the case where they are low. The case in which the spring constant of the exhaust valve opening spring 160 or closing spring 140 is high is shown as the chain line, and the other case in which the spring constant is low is shown as the solid line. Referring to FIG. 4, concerning the transition time T in which the exhaust valve 32 moves from the full closed position to the full open position, T1 is less than T2, here T1 is the transition time in the case where the spring constants of the exhaust valve opening spring 160 and closing spring 140 are large, and T2 is the transition time in the case where both spring constants are small.

As mentioned above in this embodiment, the spring constants of the exhaust valve opening and closing springs 160, 140 are set large, and the diameter of the exhaust valve 32 is smaller than the diameter of the intake valve 30. The higher the spring constants of both springs 160, 140 are, the higher the moving speed of the exhaust valve 32 is. Furthermore, the lower the mass of the exhaust valve 32 is (that is, the smaller the diameter of the exhaust valve 32 is), the higher the moving speed of the exhaust valve 32 is. Therefore, the transition time of the exhaust valve 32 becomes shorter, since the moving speed of the exhaust valve 32 becomes higher in this embodiment.

If the transition time of the exhaust valve 32 becomes shorter, the exhaust valve 32 moves more quickly from the full closed to full open position. In this case, the time in which the exhaust valve 32 is hold at the full open position becomes longer, (that is, the acting angle of the internal combustion engine 10 becomes higher). Accordingly, the gas in the combustion chamber 24 after the combustion process is exhausted smoothly. Since a high exhaust efficiency can be obtained as mentioned above, a high torque can be obtained even in the high revolutions of the:

engine 10. Consequently, the output torque can be improved in the high revolutions range, according to this embodiment.

Incidentally, the aforementioned upper and lower electromagnets generate electromagnetic force.

In this embodiment, the spring constants of the intake valve opening and closing springs 60, 40 are equal or substantially equal, and at the same time the spring constants of the exhaust valve opening and closing springs 160, 140 are also equal or substantially equal, however, this invention is not so limited. It can be designed that the spring constant of the exhaust valve opening spring 160 is greater than the spring constant of the exhaust valve closing spring 140. Furthermore, it can be designed that the spring constant of the intake valve opening spring 60 is equal to or substantially equal to the spring constant of the intake valve closing spring 40, with the condition where the spring constant of the exhaust valve opening spring 160 is greater than the spring constant of the exhaust valve closing spring 140.

Figure 5:
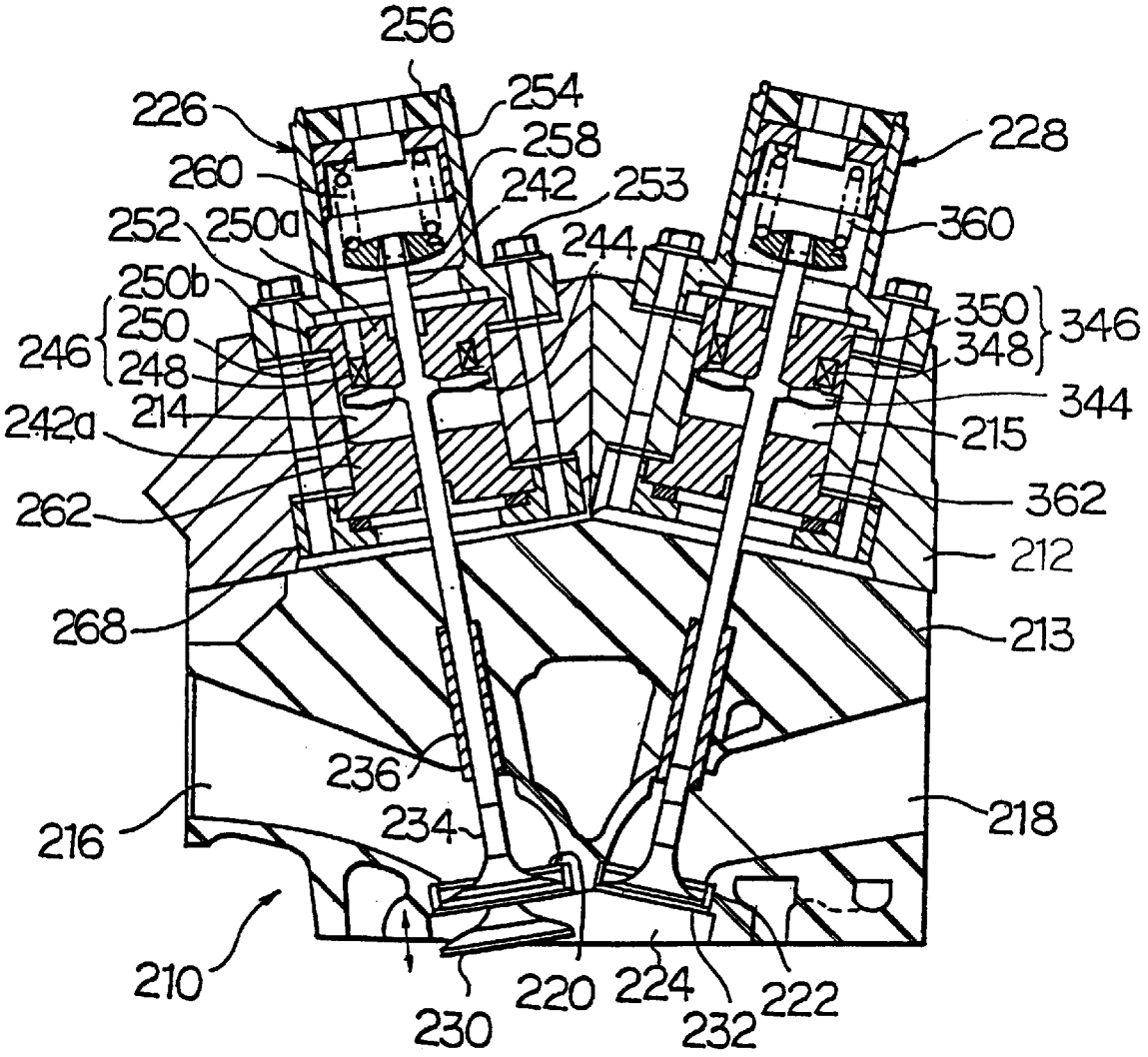
FIG. 5 is a part of a longitudinal cross-sectional view of an internal combustion engine with a valve driving apparatus according to a modified embodiment of the present invention.

FIG. 5 shows another embodiment of a valve driving apparatus. In FIG. 5, the number of the part corresponding to the valve driving apparatus shown in FIG. 1 is added by 200. In this embodiment, an intake and an exhaust valve driving apparatuses 226, 228 respectively have only an intake and an exhaust upper electromagnets 246, 346, and have an intake and an exhaust lower parts 262, 362 respectively, instead of an intake and an exhaust lower electromagnets. Except these points the intake and exhaust valve driving apparatuses 226, 228 are the same as the above-mentioned ones 26, 28. When an exciting electric current is supplied to an intake upper coil 248, an intake armature 244 is attracted toward an intake upper core 250 against an exerted force by an intake valve opening spring 260. The position when the intake armature 244 touches the intake upper core 250 is the full closed position of an intake valve 230. If the supplied exciting current to the intake upper coil 248 is suspended at the full closed position, the intake armature 244 moves downward by the force of the intake valve opening spring 260. The intake armature 244 moves toward the intake lower part 262. When the intake armature 244 touches the intake lower part 262, the intake valve 230 is at the full open position.

In the above-mentioned intake valve driving apparatus 26 in the original embodiment, the intake armature 44 is set at the neutral position when the exciting current is not supplied. In this intake valve driving apparatus 226, however, the intake armature 244 is held at the full open position when the exciting current is not supplied.

Concerning an exhaust valve driving apparatus 228, the structure and moving action are the same as the aforementioned intake valve driving apparatus 226, then the explanation is omitted here. For examples, a diameter of an exhaust valve 232 is smaller than a diameter of the intake valve 230, and a spring constant of an exhaust valve opening spring 360 is greater than a spring constant of the intake valve opening spring 260.

As mentioned above, since the intake valve and exhaust valve driving apparatuses 226, 228 respectively do not include intake and exhaust lower electromagnets, the cost is reduced.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A valve driving apparatus for driving an intake valve and an exhaust valve, using electromagnetic force, provided in an internal combustion engine, said intake and exhaust valves each being movable between an open position and a closed position, said valve driving apparatus comprising:

an intake armature coupled with said intake valve;

an exhaust armature coupled with said exhaust valve;

an intake valve spring for generating a force exerted on said intake valve; and an exhaust valve spring for generating a force exerted on said exhaust valve, wherein a spring constant of said exhaust valve spring is greater than a spring constant of said intake valve spring.

2. The valve driving apparatus according to claim 1, wherein a diameter of said exhaust valve is smaller than a diameter of said intake valve.

3. A valve driving apparatus for driving an intake valve and an exhaust valve, using electromagnetic force, provided in an internal combustion engine, said intake and exhaust valves each being movable between an open position and a closed position, said valve driving apparatus comprising:

an intake armature coupled with said intake valve;

an exhaust armature coupled with said exhaust valve;

an intake valve opening spring for generating a force exerted on said intake valve in the direction of the open position of said intake valve; and an exhaust valve opening spring for generating a force exerted on said exhaust valve in the direction of the open position of said exhaust valve, wherein a spring constant of said exhaust valve opening spring is greater than a spring constant of said intake valve opening spring.

4. The valve driving apparatus according to claim 3, wherein a diameter of said exhaust valve is smaller than a diameter of said intake valve.

5. A valve driving apparatus for driving an intake valve and an exhaust valve, using electromagnetic force, provided in an internal combustion engine, said intake and exhaust valves each being movable between an open position and a closed position, said valve driving apparatus comprising:

an intake armature coupled with said intake valve;

an exhaust armature coupled with said exhaust valve;

an intake valve opening spring for generating a force exerted on said intake valve in the direction of the open position of said intake valve;

an intake valve closing spring for generating a force exerted on said intake valve in the direction of the closed position of said intake valve;

an exhaust valve opening spring for generating a force exerted on said exhaust valve in the direction of the open position of said exhaust valve; and an exhaust valve closing spring for generating a force exerted on said exhaust valve in the direction of the closed position of said exhaust valve, wherein a spring constant of said exhaust valve opening spring is greater than a spring constant of said intake valve opening spring.

6. The valve driving apparatus according to claim 5, wherein a spring constant of said exhaust valve opening spring is equal to or substantially equal to a spring constant of said exhaust valve closing spring.

7. The valve driving apparatus according to claim 6, wherein a spring constant of said intake valve opening spring is equal to or substantially equal to a spring constant of said intake valve closing spring.

8. The valve driving apparatus according to claim 5, wherein a spring constant of said exhaust valve opening spring is greater than a spring constant of said exhaust valve closing spring.

9. The valve driving apparatus according to claim 8, wherein a spring constant of said intake valve opening spring is equal to or substantially equal to a spring constant of said intake valve closing spring.

10. The valve driving apparatus according to claim 5, wherein a diameter of said exhaust valve is smaller than a diameter of said intake valve.

11. The valve driving apparatus according to claim 6, wherein a diameter of said exhaust valve is smaller than a diameter of said intake valve.

12. The valve driving apparatus according to claim 7, wherein a diameter of said exhaust valve is smaller than a diameter of said intake valve.

13. The valve driving apparatus according to claim 8, wherein a diameter of said exhaust valve is smaller than a diameter of said intake valve.

14. The valve driving apparatus according to claim 9, wherein a diameter of said exhaust valve is smaller than a diameter of said intake valve.

* * * * *